United States Patent [19]

Rosenstock et al.

[11] Patent Number: 4,938,045

[45] Date of Patent: Jul. 3, 1990

[54] METHOD OF ASCERTAINING THE MAGNITUDE OF FORCES ACTING UPON ROLLS IN ROLLING MILLS

[76] Inventors: Hans G. Rosenstock, Robert-Koch-Strasse 8, D-6625 Püttlingen; Siegfried Wienecke, Kleyer Weg 91d, D-4600 Dortmund-Kley, both of Fed. Rep. of Germany

[21] Appl. No.: 263,424

[22] Filed: Oct. 27, 1988

[30] Foreign Application Priority Data

Oct. 31, 1987 [DE] Fed. Rep. of Germany ..... 3736999

[51] Int. Cl.[5] ..... B21B 13/00

[52] U.S. Cl. ..... 72/19; 72/241.2; 29/116.2

[58] Field of Search ..... 72/19, 20, 242, 243; 29/116.2, 112

[56] References Cited

U.S. PATENT DOCUMENTS

| | | | |
|---|---|---|---|
| 3,404,550 | 10/1968 | Plaisted | 72/19 |
| 3,518,858 | 7/1970 | Kamata | 72/19 |
| 3,628,388 | 12/1971 | Fapiano | 72/19 |
| 4,320,643 | 3/1982 | Yasuda et al. | 72/19 |
| 4,481,799 | 11/1984 | Glattfelder et al. | 72/19 |
| 4,509,237 | 4/1985 | Volz et al. | 29/116.2 |
| 4,644,860 | 2/1987 | Brendel | 29/116.2 |

*Primary Examiner*—Howard N. Goldberg
*Assistant Examiner*—I. Cuda
*Attorney, Agent, or Firm*—Peter K. Kontler

[57] ABSTRACT

The magnitude of forces which act upon the rolls in rolling mills can be ascertained by directly monitoring the extent of deformation of the rolls under the action of forces which are applied to the rolls in actual use of the rolling mill. The monitoring step includes measuring the extent of deformation of each roll at a plurality of different locations. The rolls are preferably made, at least in part of a high quality alloy known as X5 NiCrTi 25 15 which renders it possible to dispense with surface cooling of the rolls. The monitoring involves a determination of rolling force FN, of the horizontal component FH of rolling force, of the vertical component FS of rolling force, and of the angle gamma between the direction of action of the rolling force and the vertical.

3 Claims, 5 Drawing Sheets

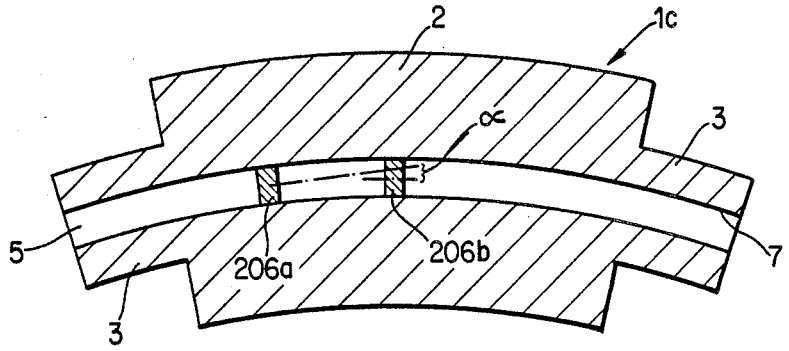
FIG. 4
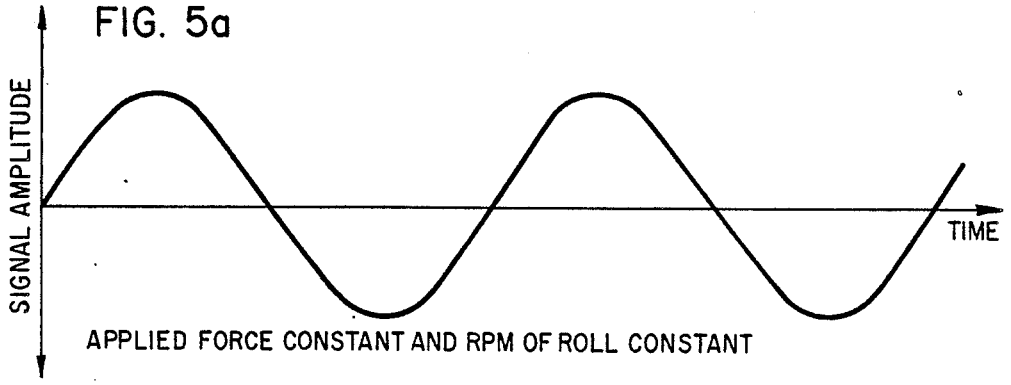
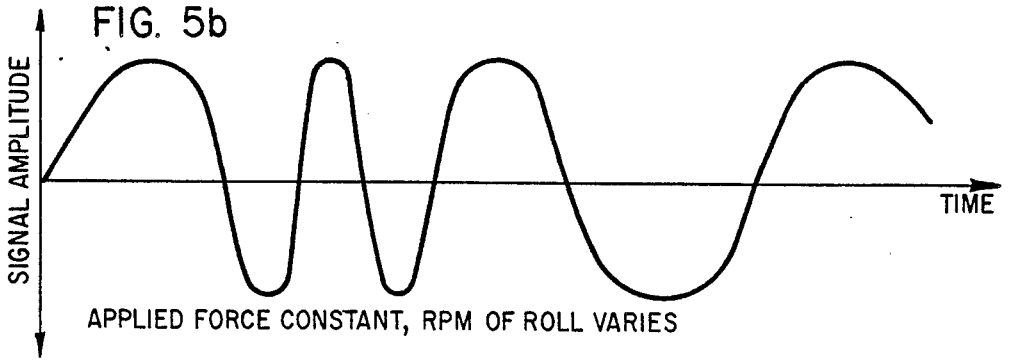
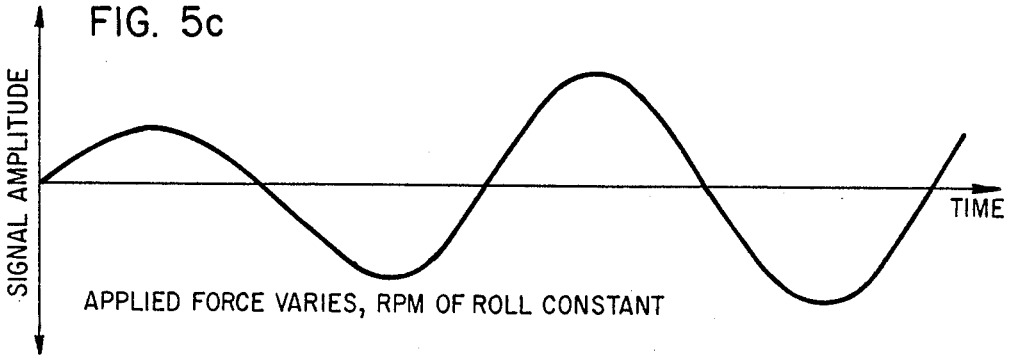

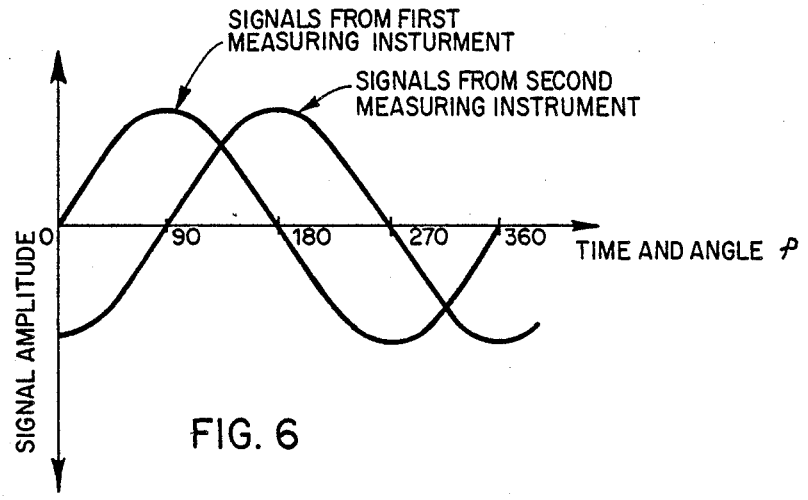
FIG. 6
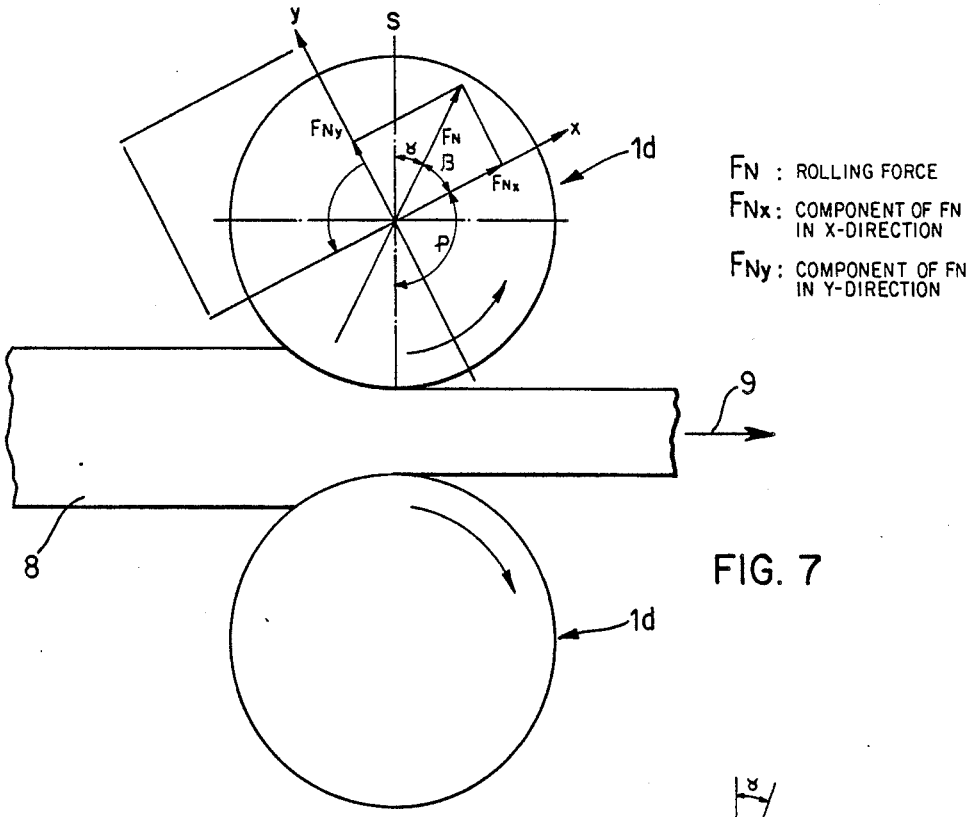
FIG. 7
FIG. 8
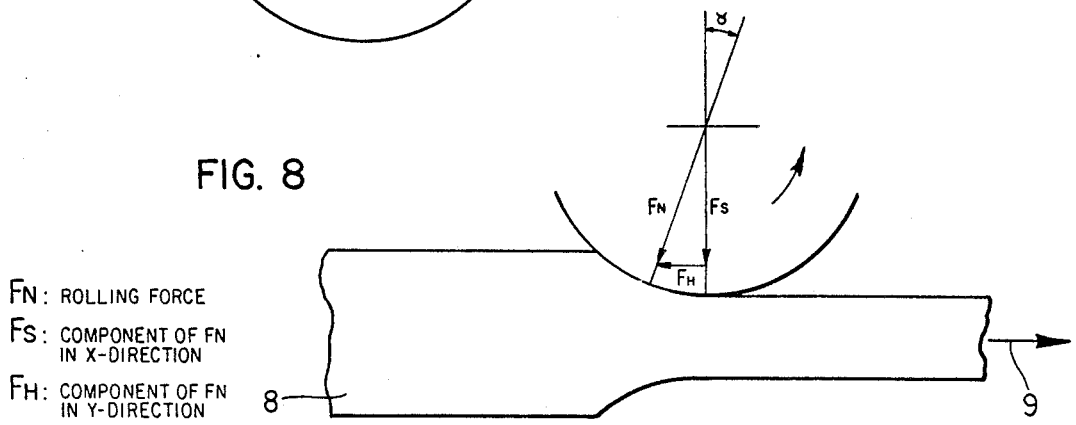

UTILIZATION OF STRETCHING AND OF THE DIRECTION OF THE ROLLING FORCE FN FOR REGULATION OF PULL

UTILIZATION OF MEASURED STRETCHING FOR PREVENTION OF DAMAGE TO ROLLS

UTILILIZATION OF STRETCHING AND OF THE DIRECTION OF ROLLING FORCE FN FOR THE REGULATION OF FN

METHOD OF ASCERTAINING THE MAGNITUDE OF FORCES ACTING UPON ROLLS IN ROLLING MILLS

BACKGROUND OF THE INVENTION

The invention relates to rolling mills in general, and more particularly to improvements in methods of ascertaining the magnitude of forces which act upon the rolls of a rolling mill while the mill is in actual use. The invention also relates to improvements in rolls which can be used in rolling mills and to instruments which can be used for carrying out the measurements.

It is often desirable and/or necessary to ascertain the magnitude of forces which act upon the rolls of a rolling mill when the mill is in actual use. Such ascertainment of forces is often important in mills which operate with cylindrical rolls as well as in mills which employ grooved rolls. The magnitude of forces acting upon the rolls in actual use of the mills is indicative of the extent of deformation of the rolls. For example, reliable monitoring of the magnitude of forces renders it possible to forestall or detect in time potential or actual breaks as a result of overstressing of the rolls. Furthermore, it is possible to properly regulate tensile stresses which are transmitted between discrete roll stands by the material which is being subjected to a rolling operation; this can be achieved by appropriate selection of the stand RPM and/or appropriate adjustment of the stands. Still further, a monitoring of the magnitude of forces which act upon the rolls renders it possible to properly evaluate and control the rolling operation as to reproducibility as well as to improve the economy of operation and prolong the useful life of the rolls and of the entire mill.

In accordance with heretofore known proposals, the magnitude of forces which act upon the rolls in a rolling mill is determined indirectly by measuring the magnitude of forces which act upon the bearings for the rolls. Such measurement is not always reliable because it takes place at a locus which is remote from the region of maximum deformation of the rolls and from the point or points of application of the force. Moreover, manufacturing tolerances contribute to distortion of the results of such measurement at the bearings. Still further the measurement takes place with a certain delay following the application of forces to the rolls. Last but not least, hysteresis can adversely influence the accuracy of measurements at the bearings. Heretofore known measurements must be carried out by resorting to bulky, complex and expensive apparatus which are prone to malfunction.

OBJECTS OF THE INVENTION

An object of the invention is to provide a novel and improved method of ascertaining the extent of deformation of rolls in rolling mills which is simpler and more reliable than heretofore known methods.

Another object of the invention is to provide a method which renders it possible to prolong the useful life of the rolling mill, of the roll stands and of the rolls.

A further object of the invention is to provide a method which renders it possible to undertake all necessary steps as soon as the monitoring of the magnitude of forces indicates that a corrective measure is advisable or necessary.

An additional object of the invention is to provide a novel and improved roll for use in a rolling mill, and to construct the roll in such a way that it is susceptible of monitoring in accordance with the above outlined method.

Still another object of the invention is to provide a novel and improved combination of a roll for use in rolling mills and of means for monitoring the magnitude of forces which act upon the roll in actual use of the mill.

SUMMARY OF THE INVENTION

One feature of the invention resides in the provision of a method of ascertaining the magnitude of forces acting upon a grooved or cylindrical roll in a rolling mill. The method comprises directly monitoring the extent of deformation of the roll as a result of the application of forces to the roll in the course of a rolling operation. The monitoring step preferably includes measuring the extent of deformation of the roll at at least two different locations which are offset relative to each other in the circumferential direction of the roll.

The measuring step is preferably carried out in the absence of surface cooling of the roll. This can be achieved by making the roll of a highly heat-resistant material which ensures long service life of the roll. In accordance with a presently preferred embodiment, the roll consists of an alloy containing (by weight) of 0.05% C, 0.50% Si, 1.80% Mn, 15.00% Cr, 1.35% Mo, 25.00% Ni, 0.20% V, 2.10% Ti and 0.005% B, the balance being impurities.

Another feature of the invention resides in the provision of a combination of a roll for use in a rolling mill with at least two deformation monitoring instruments having means for directly measuring deformation of the roll at a plurality of different locations while the roll is in use. As mentioned above, the roll can consist of 0.05% C, 0.50% Si, 1.80% Mn, 15.00% Cr, 1.35% Mo, 25.00% Ni, 0.20% V, 2.10% Ti and 0.005% B, the balance being impurities.

At least one of the instruments can include means for optically, mechanically or electrically measuring deformation of the roll in the respective direction.

The novel features which are considered as characteristic of the invention are set forth in particular in the appended claims. The improved roll itself, both as to its construction and the mode of monitoring the same, as well as the means for measuring its deformation, will be best understood upon perusal of the following detailed description of certain presently preferred embodiments with the reference to the accompanying drawing.

BRIEF DESCRIPTION OF THE DRAWING

FIG. 4 is an axial sectional view of the roll of FIGS. 2a–3b but different measuring means in the axial hole;

FIG. 5a is a diagram showing a sinusoidal curve which denotes the signals generated by a measuring instrument when the RPM of the roll is constant and the magnitude of the force acting upon the roll is also constant;

FIG. 5b is a similar diagram but showing a curve which denotes signals indicative of deformation of the roll when the applied force is constant but the RPM of the roll varies;

FIG. 5c is a similar diagram but showing a curve which denotes a signal that represents the deformation of the roll when the applied force varies while the RPM of the roll remains constant;

FIG. 6 is a diagram with curves denoting the signals which are generated by two measuring instruments installed at an angle of 90° relative to each other;

FIG. 7 illustrates a portion of the stock during passage between two rolls and the manner of determining the direction of rolling force;

FIG. 8 shows a portion of the structure of FIG. 7 and the manner of dividing the rolling force into horizontal and vertical components;

DESCRIPTION OF PREFERRED EMBODIMENTS

Figure 1A:
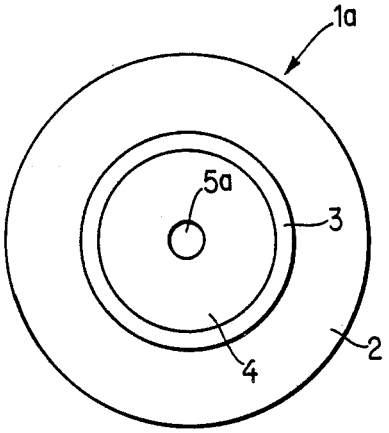
FIG. 1*a* is an end elevational view of a roll wherein the shaft is provided with an axial hole for several measuring instruments.

FIG. 1a shows a first roll 1a which includes a cylindrical or grooved main portion 2 with two journals 3 (one shown) at the ends, and a steel shaft 4 which is coaxial with and extends through the main portion 2 and journals 3. The shaft 4 has an axial bore or hole 5a (hereinafter called hole) for several measuring instruments which will be described hereinafter.

Figure 1B:
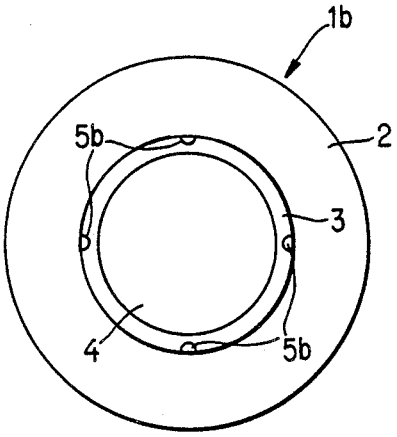
FIG. 1*b* is a similar end elevational view of a modified roll wherein the measuring instruments are installed in several discrete holes which are remote from the axis of the roll.

FIG. 1b shows a modified roll 1b having a grooved or cylindrical main portion 2, two journals 3 (one shown), a shaft 4, and four equidistant holes 5b which are eccentric to the axis of the shaft 4 and are provided in the roll 1b in the region of the peripheral surfaces of the journals 3. Each of the holes 5b can receive a measuring instrument or the overall number of measuring instruments can be less than the number of holes 5b.

The measuring instruments in the hole 5a or in the holes 5b can constitute commercially available wire (resistance) strain gauges, semiconductor type deformation (expansion) measuring gauges, optically operated gauges and/or others. All that counts is to provide at least two measuring instruments which can convert values denoting stretching, flexing, bending and similar deformation of the roll 1a or 1b into signals for use in regulating the operation of the rolling mill in which the roll is put to use.

Figure 2A:
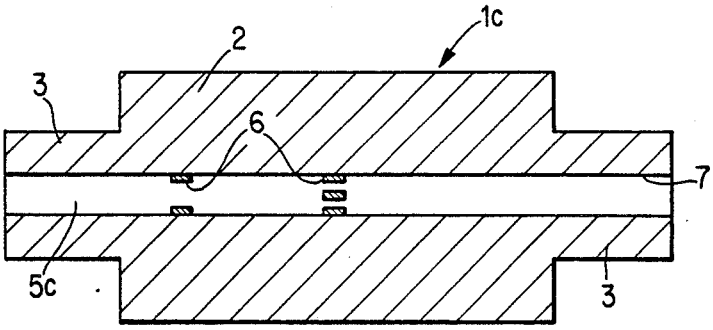
FIG. 2*a* is an axial sectional view of a modified roll with an axial hole for measuring instruments.
Figure 2B:
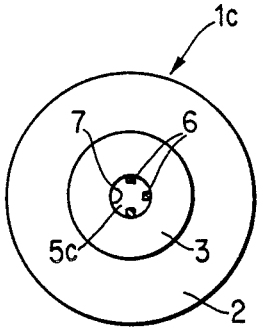
FIG. 2*b* is an end elevational view of the roll which is shown in FIG. 2*a;*

FIGS. 2a and 2b show a roll 1c which includes a main portion 2 and two journals 3 and has an axial hole 5c for several suitably distributed measuring instruments 6 which are affixed (e.g., bonded) to the surface 7 surrounding the hole 5c. The main portion 2 of the roll 1c is a cylinder; however, it is equally possible to employ a grooved roll.

Figure 3A:
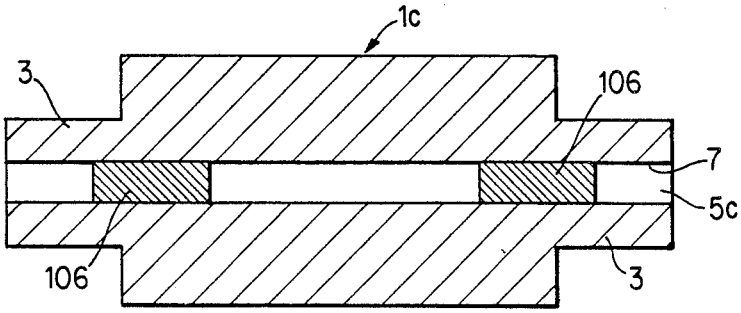
FIG. 3*a* is an axial sectional view of the roll of FIGS. 2*a*–2*b* but with different measuring instruments in the axial hole.
Figure 3B:
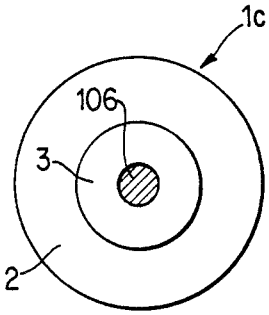
FIG. 3*b* is an end elevational view of the roll which is shown in FIG 3*a;*

The roll 1c of FIGS. 3a and 3b is identical with the roll of FIGS. 2a and 2b. The measuring instruments 6 are replaced with two discrete measuring instruments 106 which are introduced (e.g., pushed) into the hole 5c and each of which constitutes or includes a separate circuit. The main portion 2 of the roll 1c is a cylinder; however, it is equally possible to install the instruments 106 in a grooved roll.

The roll 1c of FIG. 4 (shown in a state of deformation greatly exceeding that anticipated in a rolling mill) is identical with the roll 1c of FIGS. 2a–2b or 3a–3b. The measuring means in the hole 5c includes a radiation source 206a and a single optoelectronic transducer 206b, two discrete optoelectronic transducers or a flat screen. If the measuring means employs two transducers, such transducers are or can be disposed at an angle of 90 degrees relative to each other. When the roll 1c of FIG. 4 is in undeformed condition, the beam of radiation issuing from the source 206a is coaxial with the hole 5c. The angle alpha denotes the extent of deviation of the beam from the axis of the hole 5c in the region of the transducer 106b.

Referring again to FIG. 1b, each such hole 5b of the roll 1b can receive a discrete fiber optic gauge which extends in parallelism with the axis of the shaft 4 when the roll 1b is in undeformed condition. When the roll 1b is deformed, one of the gauges is stretched and the extent of such stretching in comparison with that of the gauge which is located diametrically opposite the stretched gauge is indicative of deformation of the roll 1b and hence of the magnitude of the rolling force.

The means for transmitting electric signals from the rotating or orbiting transducers of the measuring means to a receiver in the frame of the respective roll stand can include slip rings. If contact-free transmission of signals is desired, the roll and/or the stand can be equipped with means for effecting optical or electromagnetic transmission of signals from the rotating transducers to a stationary receiver in the stand.

The exact nature of monitoring or measuring means and of the means for transmitting signals from the rotating roll to a stationary receiver is of no particular importance. All that counts is to ensure that a determination of deformation of the roll (and hence of the magnitude of force or forces acting upon the roll) can be carried out in or on the roll proper and preferably as close to the locus or loci of application of one or more forces as possible. The same holds true for the nature of means for evaluating the signals which are generated by the measuring means and are transmitted from the rotating or orbiting transducers to a stationary receiver.

If one takes a selected point on the internal surface of a rotating roll, e.g., a point on the internal surface 7 of the roll 1c which is shown in FIGS. 3a and 3b, signals denoting the magnitude of forces acting upon the roll (i.e., the extent of deformation of the corresponding portion of the roll 1c) can be represented by sinusoidal curves of the type shown in FIGS. 5a, 5b and 5c. The amplitude of signals is measured along the ordinate, and the frequency of signals is measured along the abscissa. FIG. 5a shows that the amplitude and frequency of signals are constant if the roll is driven at a constant RPM and the magnitude of applied forces also remains constant. The monitored portion of the roll undergoes repeated alternating expansion and contraction or compression, depending on the relative position of the locus of application of the force. FIG. 5*b* shows that the amplitude of signals remains constant but their frequency changes if the magnitude of applied load remains constant but the RPM of the roll varies. FIG. 5*c* shows that the frequency of signals remains unchanged but the amplitude of signals changes if the RPM of the roll remains constant but the magnitude of the forces changes. Thus, the frequency of signal changes is proportional to the RPM of the roll, and the amplitude of signals is a function of the magnitude of applied forces as well as of the position of the instrument relative to the direction of application of such forces.

The diagram of FIG. 6 shows two curves which represent signals furnished by two measuring instruments which are angularly offset by 90 degrees. A characteristic of such mode of ascertaining the magnitude of applied forces is that the amplitude of signal which is transmitted by one of the instruments is zero when the amplitude of the signal which is transmitted by the other instrument reaches a maximum value.

The following considerations apply when two measuring instruments are angularly offset by 90 degrees (FIG. 6). However, the situation is clearly analogous when the number of instruments is increased to three or more and/or when the angular offset of the instruments is greater or less than 90 degrees. All that counts in connection with the explanations that follow is that the monitoring means comprise at least two measuring instruments and that deformation of the roll is measured at several locations which are angularly offset relative to each other.

Referring to FIG. 7, there are shown two identical rolls 1*d* which act upon a metallic stock 8 moving in the direction of arrow 9. The directions x and y of measurement make an angle of 90 degrees. The momentary angular position with reference to the vertical S is denoted by the angle phi. The rolling force FN, whose magnitude is to be ascertained, has two components FNx and FNy. The component FNx acts in the direction of the x-axis and the component FNy acts in the direction of the y-axis of the rectangular coordinate system which is shown in FIG. 7. The angle beta between the direction of action of the force FN and the abscissa of the coordinate system can be calculated in accordance with the equation $$\text{Beta} = \arctan\left(\left|\frac{FNx}{FNy}\right|\right).$$

The angle phi (i.e., the angle between the abscissa x and the vertical S can be ascertained by resorting to any conventional angle measuring instrument, for example, a commercially available incremental transmitter. Once the angles beta and phi are known, the direction of the rolling force FN can be ascertained with the equation gamma=180° minus phi minus beta. In this manner, one can always determine the orientation (angle gamma) of the applied force with reference to the vertical S.

Basically, the force FN represents a rectified signal, the absolute magnitude (value of FN) of which is indicative of the absolute value of load and the orientation of which with reference to the vertical S is denoted by the angle gamma.

FIG. 8 shows a portion of an upper roll 1*d*, the stock 8 and the direction (arrow 9) of advancement of stock 8 past the roll 1*d*. FIG. 8 further shows how the force FN can be vectorially split into a horizontal component FH and a vertical component FS. In the case of a satisfactory rolling force measurement, the vertical component FS denotes the magnitude of the vertical force acting upon the bearing of the roll 1*d*. The horizontal component FH is a function of deformation conditions and of friction in the rolling gap. Furthermore, the horizontal component FH can further include tensional forces which are transmitted by the stock 8.

Figure 9:
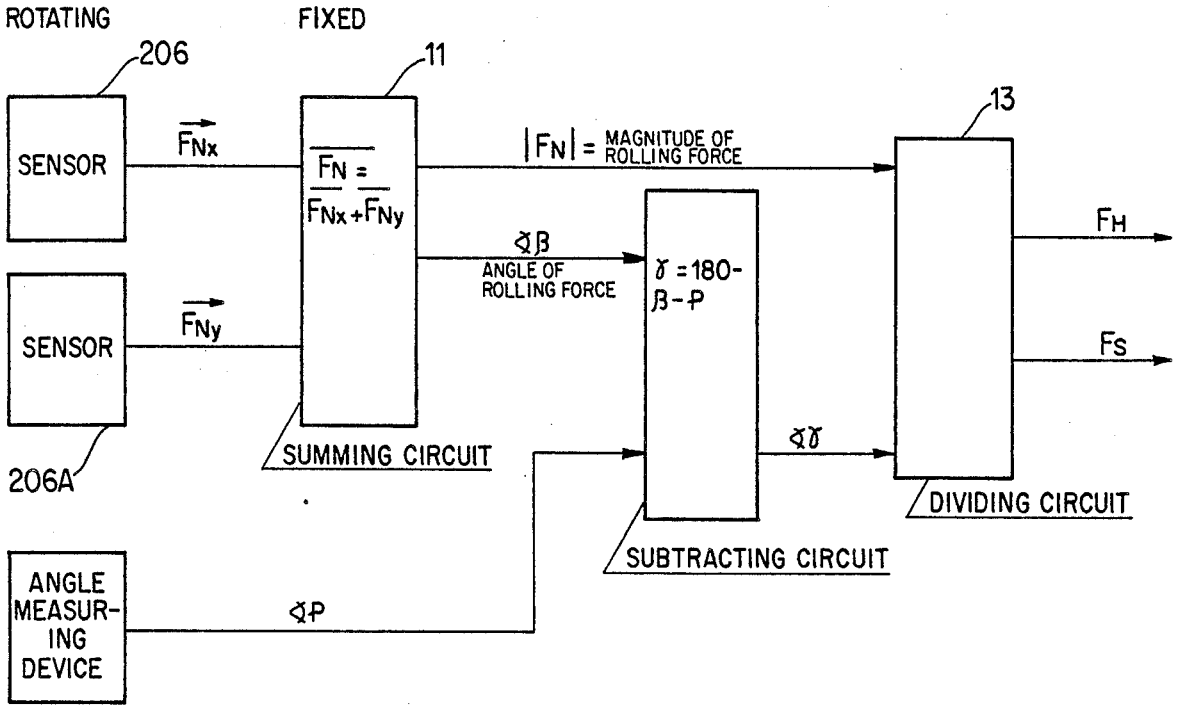
FIG. 9 is a diagram showing the manner of processing signals which are transmitted by two measuring instruments and an angle measuring device so as to ascertain the horizontal and vertical components of the rolling force.

The manner of ascertaining the sought-after values of FN, FN and gamma, which were discussed in the description of FIGS. 7 and 8, on the basis of discrete signals from two measuring instruments or sensors 206,206A which denote forces acting in the x- and y-directions of the rotating roll and on the basis of measurements of the angle phi, as well as the manner of splitting the rolling force FN into its horizontal and vertical components FH and FS is shown in the diagram of FIG. 9. The angle measuring instrument is shown at 10, the box 11 denotes a summing circuit, the box 12 denotes a subtracting circuit, and the box 13 denotes a dividing circuit. The outputs of the circuit 13 transmit signals denoting the magnitude of components FH and FS.

Figure 10:
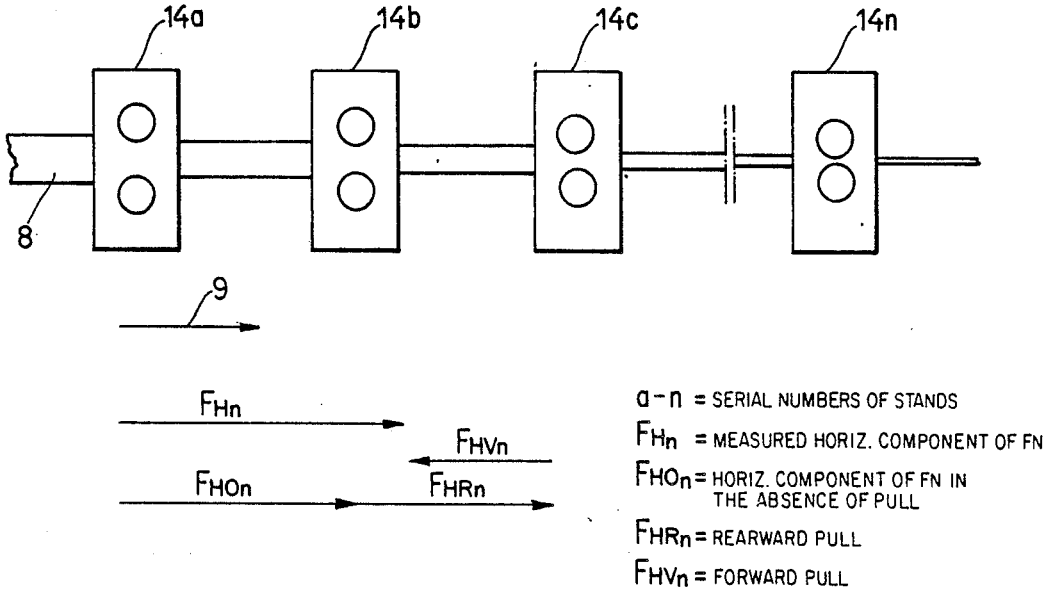
FIG. 10 is a plan view of a rolling mill with a series of successive roll stands.

In the course of a continuous rolling operation, the stock 8 which requires treatment can simultaneously extend through several consecutive roll stands 14*a*, 14*b*, 14*c* . . . 14*n* (see FIG. 10). In order to achieve reproducible results, it is important to ascertain the magnitude of tensional forces which are transmitted by the advancing stock 8 between neighboring roll stands. By ascertaining the magnitude of such forces, it is possible to properly influence the RPM of the roll stands and the adjustment of roll stands in order to maintain the tensional forces at a desired level. The characters a, b, c . . . n denote the serial numbers of successive roll stands 14, FH denotes the measured horizontal component of the rolling force, FHO denotes the horizontal component of the rolling force when no pull is exerted by the stock, FHR denotes the rearward pull of the stock counter to the direction of arrow 9 (i.e., the pull which is exerted by a preceding stand, such as the stand 14*a*, upon the next-following stand e.g., the stand 14*b*), and FHV denotes the forward pull upon the stock 8 by a next-following stand (14*b*, 14*c* . . . 14*n*).

The horizontal component FH of the rolling force at any stage of a rolling operation is obtained by vectorial addition of FHO+FHR−FHV. The following considerations apply for calculations of the magnitude of FHO, FHR and FHV on the basis of the only available value, namely that of FH:

(1) No rearward pull is exerted upon the stock 8 during entry into the foremost roll stand (14*a*) of a rolling mill or a portion of a rolling mill. Moreover, and before the head of stock 8 reaches the next-following stand (14*b*), the stock is not subjected to any forward pull, i.e., at such time FHRa=0, FHVa=0 and FH=FHO. Thus, the measured horizontal component FH corresponds to FHO and is not influenced by the pull. This magnitude of FHO for the roll stand 14*a* can be memorized as (FHO)a.

(2) When the head of the stock 8 enters the second roll stand **14*b*, the measured value of FH at the first roll stand 14*a*** changes by the amount FHV. Thus, $$(FH)a=(FHO)a-(FHV)a.$$

The pull between the roll stands **14*a* and 14*b***, namely the value (FHV)a, can be expressed in terms of a difference between the memorized value (FHO)a for the pull-free rolling operation and the momentary value (FH)a as follows:

$$(FHV)a=(FHO)a-(FH)a.$$

The forward pull upon the first roll stand **14*a* equals the rearward pull upon the roll stand 14*b* so that (FHR)b=(FHV)a. If the momentary value of horizontal component at the roll stand 14*b* is interpreted on the basis of assumption that the head of the stock 8 has not as yet reached the roll stand 14*c*, the magnitude of horizontal component (FHO)b which is to be expected to act upon the stock 8 at the discharge end of the second roll stand 14*b*** can be expressed as follows:

$$(FHO)b=(FH)b-(FHR)b.ps$$

This furnishes information as to the magnitude of horizontal component acting upon the second roll stand **14*b* while disregarding the influence of the pull, and such information can be memorized. (FHV)b will be zero as long as the head of the stock 8 is still located upstream of the third roll stand 14*c***.

(3) When the head of the stock 8 enters the third roll stand **14*c*, there exists the possibility of development of a pull between the stands 14*b* and 14*c*. If a pull develops, it can be said that (FHV)b=(FHR)c. As soon as a pull between the stands 14*b* and 14*c*** actually develops, the momentary measurement value (FH)b is changed exactly by the amount of such difference and $$(FHV)b=(FHO)b-(FH)b+(FHR)b.$$

This completes the determination of all horizontal forces pertaining to the second roll stand **14*b*. The same considerations apply for determination of horizontal forces pertaining to the next-following roll stands 14*c* . . . 14*n***.

Once the horizontal forces for the roll stands are known, it is possible to regulate the tensional forces by varying the RPM ratio of the roll stands and/or the adjustment of roll stands. The tensional force can be varied until it matches the predetermined reference value.

In order to avoid or forestall breaking of the rolls, such as could result from short-lasting excessive stressing and could entail extensive damage to the mill, one relies upon the measured value FN. The maximum permissible force (FN)max can be ascertained empirically or on the basis of calculations, and the thus determined force can be continuously compared with the actual rolling force FN. As soon as the value of FN matches or exceeds (FN)max, a comparator circuit 15 (FI. 11) transmits a signal to trigger an optical or acoustical alarm system 16. In addition, the signal at the output of the comparator circuit 15 is transmitted to the controls 17 of the rolling mill wherein an automatic device of known design influences the drive for the rolls to avoid a break.

Figure 12A:
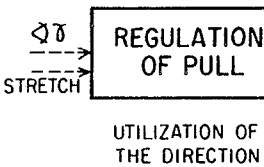
FIG. 12 is a further diagram showing the mode of evaluating and utilizing signals which are generated as a result of monitoring the deformation a roll in a rolling mill.
Figure 12B:
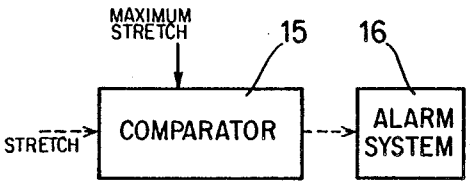
Figure 12C:
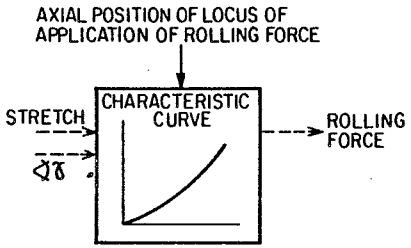

FIG. 12 is a diagram showing the possibilities of evaluating and utilizing the results of the monitoring or measuring operation.

The section (a) of the diagram shows that the angle gamma denoting the inclination of the force FN, which angle is ascertained by measuring the angle phi, is used with stretching to ascertain the pull upon the roll stand and to facilitate a regulation of the pull.

Figure 11:
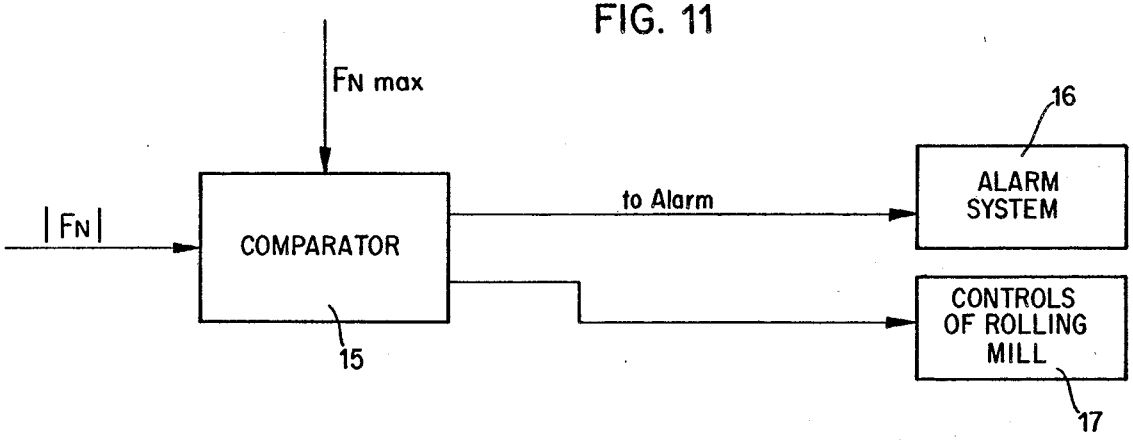
FIG. 11 is a diagram showing one mode of protecting a roll from overstressing and of indicating that an overstressing of the roll is taking place or is about to take place.

The section (b) of the diagram shows that the ascertained stretching is compared at 15 with the maximum permissible stretching in the hole of the roll and, when the comparison indicates that actual stretching matches or exceeds the maximum permissible stretching, the controls 17 receive a signal for the purposes as set forth above in connection with FIG. 11. For example, the signal which is transmitted to the controls 17 can entail rapid changes of roll adjustment.

The section (c) of the diagram shows that, by taking into consideration the locus of application of the force (in the axial direction of the roll) and by further taking into consideration the characteristic curve of the roll, the extent of stretching and the direction (angle gamma) of the rolling force FN can be relied upon to calculate the momentary magnitude of the force acting upon the roll.

In accordance with a feature of the invention, it is not necessary to cool the surfaces of the rolls. This can be achieved by employing rolls which are made of a highly temperature-resistant material and have a long service life. Such absence of cooling is in contrast to prevailing practice according to which the rolls are cooled by water. As a rule, the cooling action is unpredictable so that heating of the roll cannot be used as a parameter for determination of deforming work and of the rolling force.

The material of the roll is preferably a stable austenitic steel, preferably one listed in the Steel-Iron-Catalogue as X5 NiCrTi 25 15 with the material No. 1.4980 or 1.4944 and known in the aircraft industry under the international trade name A 286. Such alloys contain on the average 0.05% C, 0.50% Si, 1.80% Mn, 15.00% Cr, 1.35% Mo, 25.00% Ni, 0.20% V, 2.10% Ti and 0.0005% B and are presently used for the making of propulsion plants, rockets, gas turbine rotors and internal sleeves of recipients.

An important advantage of the improved method and roll, as well as of the combination of improved roll with measuring means, in connection with the assembly and operation of rolling mills is that it is not necessary to cool the surfaces of the rolls. The highly heat-resistant material of the rolls is unlikely to develop surface cracks in the course of the rolling operation. The service life of the rolls (as expressed in terms of the number of hours of actual use or in terms of tons of rolled stock) is so long that the frequency of stoppages for the purposes of replacing the rolls and/or for inspection of the rolls is greatly reduced with attendant increases of output and reduction of maintenance cost. Thermal conductivity of the improved roll is superior to that of conventional rolls. Still further, it is possible to achieve substantial savings in expensive high-quality material of the rolls because the rolls can be constructed in a manner as shown in FIGS. **1*a* and 1*b*, i.e., wherein only the hollow main portion 2 and the integral hollow journals 3 are made of a high-quality material, and these parts are simply shrunk onto a high-quality steel shaft 4**. Such types of rolls can be used in roll stands wherein the stock does not undergo excessive deformation per pass.

The utilization of several measuring instruments per roll, combined with the feature that the measurements are carried out in several angular positions with reference to the axis of the monitored roll, renders it possible to "rectify" the sinusoidal progress of individual signals while the monitored roll rotates and to thus ensure that the composite signal is devoid of zero values (where the curve denoting the signal from a particular instrument crosses the x-axis). In addition, this renders it possible to ascertain the direction of resultant force and to divide such force into its horizontal and vertical components. This, in turn, renders it possible to ascertain the forward or rearward pull between neighboring roll stands and to utilize the corresponding signals for a regulation of operation of the rolling mill.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of ascertaining the magnitude of forces acting upon a roll in a rolling mill, the roll having a main portion and journals at each end of the main portion, comprising the steps of establishing a plurality of deformation monitoring stations; distributing said stations in at least one of two directions including axially and circumferentially of the roll between the two axial ends of the roll; and directly monitoring the extent of deformation of the roll as a result of the application of forces to the roll in the course of the rolling operation at each of said plurality of monitoring stations.

2. The method of claim 1, wherein said measuring step is carried out in the absence of surface cooling of the roll.

3. The method of claim 1 of ascertaining the magnitude of forces acting upon a roll which is an alloy, said alloy consisting, by weight, of 0.5% C, 0.50% Si, 1.80% Mn, 15.00% Cr, 1.35% Mo, 25.00% Ni, 0.20% V, 2.10% Ti and 0.00% B, the remainder being impurities.

* * * * *

UNITED STATES PATENT AND TRADEMARK OFFICE

CERTIFICATE OF CORRECTION

PATENT NO. : 4,938,045

DATED : July 3, 1990

INVENTOR(S) : Hans Georg Rosenstock and Siegfried Wienecke

It is certified that error appears in the above-identified patent and that said Letters Patent is hereby corrected as shown below:

Col. 3, line 2, after "but" insert --with--.
Col. 7, line 25, "ps" should be deleted.
Col. 8, line 43, "0.0005% B" should be changed to --0.005% B--.
Col. 10, line 2, after "claims." insert --Measuring instruments which can be used in conjunction with the improved roll are known as strain gauges Type DY11 and are manufactured by Hottinger Baldwin Messtechnik, German Federal Republic.--;
line 22, "0.00% B" should read --0.005% B--.

Signed and Sealed this

Ninth Day of March, 1993

*Attest:*

*Attesting Officer*

STEPHEN G. KUNIN

*Acting Commissioner of Patents and Trademarks*